United States Patent [19]

Liedtke et al.

[11] Patent Number: 4,590,839

[45] Date of Patent: May 27, 1986

[54] PELLET DRUM STICK BRUSH

[76] Inventors: Robert W. Liedtke, 2110 8th Street North, St. Petersburg, Fla. 33713; Gerald R. Liedtke, 600 B Objibway Ave., Houghton Lake, Mich. 48629

[21] Appl. No.: 767,188

[22] Filed: Aug. 19, 1985

[51] Int. Cl.[4] ..... G10D 13/00

[52] U.S. Cl. ..... 84/422 S

[58] Field of Search ..... 84/422 S

[56] References Cited

U.S. PATENT DOCUMENTS 3,150,555 9/1964 Sage ..... 84/422 S

*Primary Examiner*—Lawrence R. Franklin

*Attorney, Agent, or Firm*—Walter J. Monacelli

[57] ABSTRACT

Disclosed is a drum brush percussion device to be used in conjunction with drums, cymbals or the like, which is capable of generating those sounds of the traditional drum brush as well as more forceful percussive tones and novel combinations thereof. This is accomplished through the use of pellets being attached to some of the bristles of a drum brush in spaced relation to the distal end of the bristles of the drum brush. Such a configuration allows the drum brush to be used to generate a diversity of sounds merely by varying the angle at which the brush strikes the drum, cymbal or the like.

10 Claims, 3 Drawing Figures

PELLET DRUM STICK BRUSH

BACKGROUND OF THE INVENTION

1. Field of the Invention

The present invention relates to drum, cymbal, and percussion instrument beating devices, and more particularly a drum beating device that is capable of incorporating the sounds of a drum brush, a drumstick, and a drum beater brush with balls, and producing a new and different sound by striking the instrument at varying angles.

2. Brief Description of the Prior Art

There have been attempts to design a wire type drum brush beater used to produce a specific sound when striking drums, cymbals or the like. The Calato Patent (U.S. Pat. No. 4,028,983) entitled "Adjustable Drum Brush" purports to teach a drum brush in which a plurality of wire bristles are movable to selected positions so that portions of the bristles extend outwardly from the handle to a particular desired length. The length at which the bristles are set controls the spread of the brush and, therefore, it appears that the manipulator of the brush can vary the sound obtained when using the brush on drums or cymbals and the like. The adjustable brush type device taught by Calato, apparently is able to produce varying brush percussion sounds, similar to those made by narrow, intermediate and wide spread brushes traditionally used by drummers. It is, however, unable to produce the volume or variety of forceful percussive sounds of the present invention or the combination of traditional drum brush and forceful percussive sounds that can also be produced by the present invention.

Another Patent to W. P. Sage (U.S. Pat. No. 3,150,555), entitled "Beater for Drum," allegedly teaches a beater for drums, cymbals and the like in which each wire bristle terminates in a ball-like solid body. The result is that the Sage device apparently produces sounds with greater percussive intensity than the traditional drum brush while being unable to duplicate, those sounds one is able to produce with a traditional drum brush.

The teachings in the field, therefore, are limited and fail to teach a drum brush in which all of the soft background sounds of a traditional drum brush can be duplicated as well as being able to produce more forceful percussive sound or a combination thereof.

SUMMARY OF THE INVENTION

It is, therefore, an object of the present invention to provide a new and useful drum brush capable of producing a new sound.

It is a further object of the present invention to provide a drum brush which, in addition to providing a new sound as outlined above, is capable of producing the traditional sounds associated with drum brushes.

Another object of the present invention is to provide a device which the user can manipulate to produce either a new sound, the traditional drum brush sounds, the sound produced by the Sage Drum Beater (U.S. Pat. No. 3,150,555), or any combination of the foregoing.

Briefly stated, the foregoing and numerous other features, objects and advantages of the present invention will become readily apparent upon a reading of the detailed description, claims and drawings set forth hereinafter, and are accomplished through the use of a drum brush with a plurality of wire bristles upon which are attached beads, balls, pellets or which bristles are simply characterized by protuberances, each disposed at some distance from the distal and proximal ends of the wire bristles. The drum brush assembly is additionally attached to a handle made of wood or other suitable material for holding the drum brush while producing the desired sound or sounds by striking the pellet drum stick against the sound producing surface of a drum, cymbal or other percussion instrument or the like.

DETAILED DESCRIPTION OF THE PREFERRED EMBODIMENT

Figure 1:
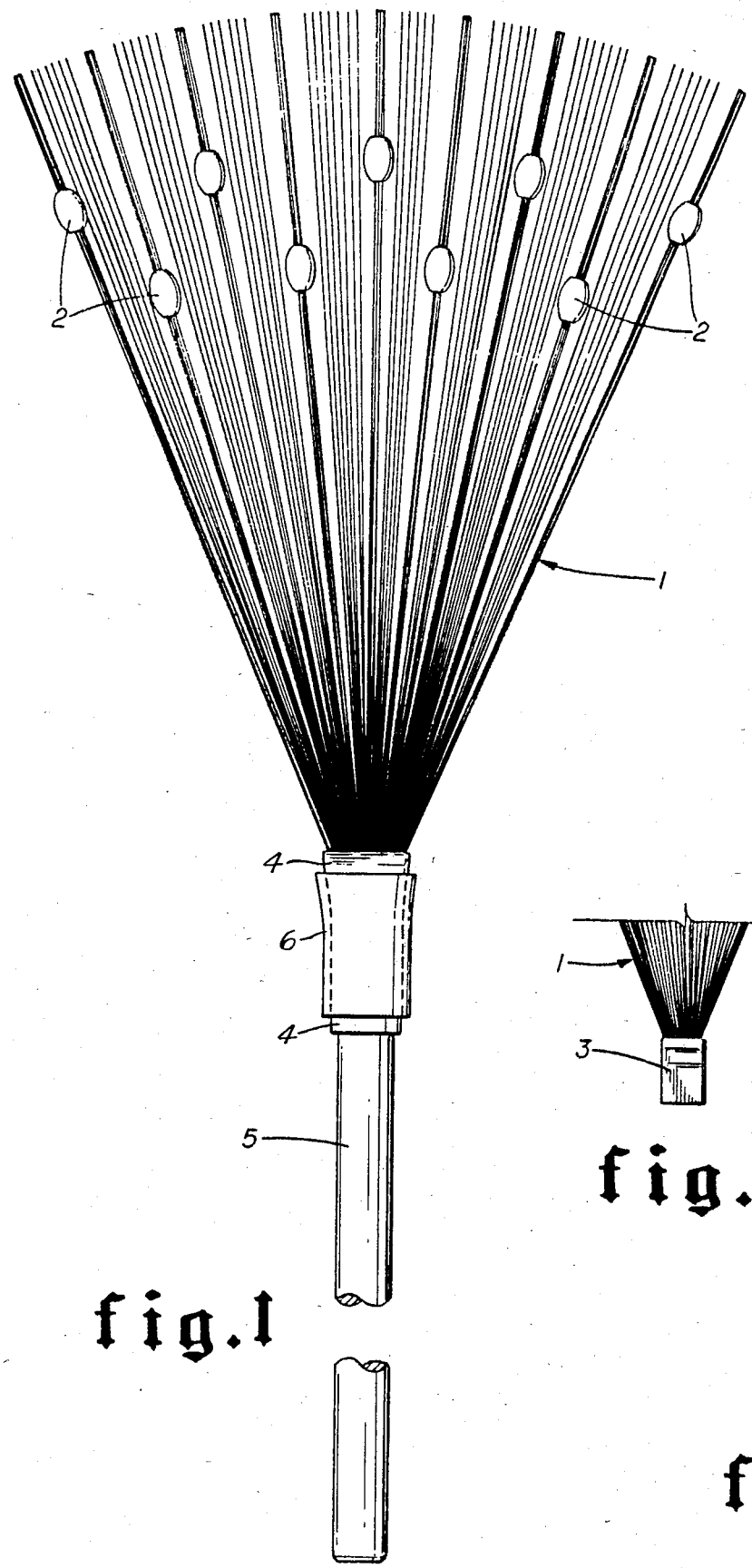
FIG. 1 is a front elevation of the drum brush of the present invention.
Figure 3:
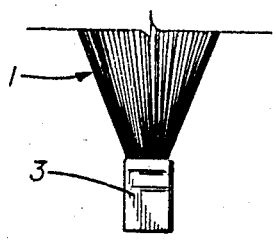
FIG. 3 is a detail drawing showing the individual wires comprising the drum brush permanently affixed in one single group by the use of a crimped fastener.
Figure 2:
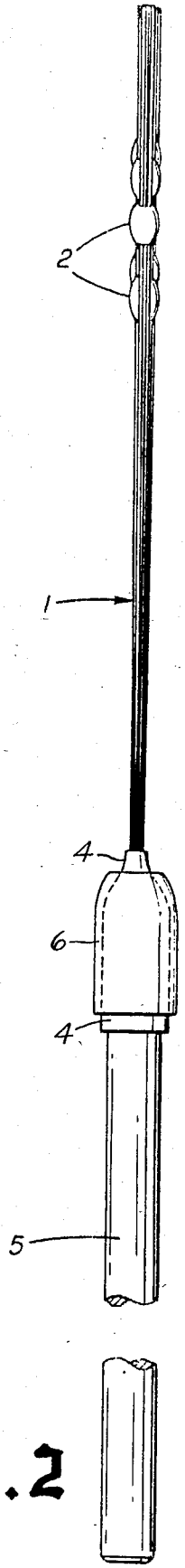
FIG. 2 is a side elevation of the drum brush of the present invention.

Referring now to the drawings, the drum brush as illustrated in FIGS. 1 and 2 comprises a plurality of wire bristles 1 to which are attached pellets 2, or which wire bristles are variously characterized by protuberance means (2). The protuberance means or pellets 2 may be in the form of balls, beads or the like. It will be recognized hereafter that the term "pellets" will therefore include the various forms of protuberance means disposed, as described hereinafter, on the bristles. Through the center of each pellet is a borehole of sufficient size so as to contain approximately seven (7) of the wire bristles 1. The shape of pellets 2 may be spherical, rounded, ellipsoid or of any shape which has a smooth surface so as not to damage the percussion instrument while in use. It will be recognized that the protuberance means may be simply disposed at the end of certain of said wire bristles which are shorter in length than certain of the other of said wire bristles.

Pellets 2 are affixed to the wire bristles 1 by the means of an adhesive compound. In the preferred embodiment, pellets 2 are ellipsoid in shape and made of wood.

The wire bristles 1 extend and fan out from a connecting sleeve 4. The connecting sleeve 4 connects to the handle 5. At the end of the connecting sleeve 4 through which the wire bristles 1 extend, the connecting sleeve 4 is crimped such that a slot is formed which causes the wire bristles 1 to fan out in a substantially planar fashion.

The pellets 2 are attached to the groups of wire bristles 1 in a configuration as shown in FIG. 1. The pellets 2 are affixed to groups of wire bristles 1 alternating distances from the distal end of the wire bristles 1 such that two arcs of pellets 2 are formed across the fanned out wire bristles 1. In the first arc of pellets 2, the pellets 2 are affixed to groups of wire bristles 1 at a distance of approximately one inch from the distal end of the wire bristles. In a second arc of pellets 2, the pellets 2 are affixed to groups of wire bristles 1 at a distance of approximately two inches from the distal end of the wire bristles 1. Between each group of bristles 1 there are additional wire bristles 1 having no pellets 2 attached thereto, spaced between those groups of wire bristles 1 to which pellets are attached.

All of the wire bristles 1, with or without pellets 2 attached thereto, are permanently secured on the proximal ends by the means of a fastener 3 as shown in FIG.

3. This fastener 3 consists of a piece of tubing approximately ¼" in diameter, which is crimped so as to permanently bind all wire bristles 1 in a fixed position at their proximal ends. The fastener 3 is contained in the lightweight flared connecting sleeve 4.

There is a tube 6 made of a flexible plastic material which fits snugly about connecting sleeve 4. Tube 6 may be slid off of connecting sleeve 4 so that is encircles the wire bristles 1 and placed at any position along the length of wire bristles. In such manner, tube 6 serves as a choke by which the spread of the wire bristles 1 can be narrowed yielding even further versatility to the sounds which can be generated by the drum brush of the present invention.

In an alternative embodiment, all of the pellets 2 may be equidistant from the distal ends of the wire bristles 1. It would also be possible to have an embodiment in which the pellets 2 are affixed to the wire bristles 1 to form more than two arcs of pellets 2 across the drum brush.

In another embodiment, pellets 2 may be individually affixed to single wire bristles 1 as opposed to a plurality of wire bristles. Such an embodiment would be easier to manufacture as those wire bristles 1 having pellets 2 affixed thereto could be cast or extruded such that the pellet 2 are an integral part of wire bristles 1.

The drum brush of the present invention is capable of duplicating all of the sounds which can be generated with a traditional drum brush. Further, a much more forceful percussion sound can be generated by decreasing the angle at which the brush strikes the drum so that the pellets can come in direct contact with the drum. Also, it should be recognized that multiple combinations of such traditional drum brush sounds and more forceful percussion sounds can be generated merely by altering the angle at which the drum brush strikes the drum.

From the foregoing it will be seen that this invention is one well adapted to obtain all of the objects hereinabove set forth, together with other advantages which are obvious and which are inherent to the device.

It will be understood that certain features and subcombinations are of utility and may be employed with reference to other features and some combinations. This is contemplated by and is within the scope of the claims.

As many possible embodiments may be made of the invention without departing from the scope thereof, it is to understood that all matter herein set forth or shown in the accompanying drawings is to be interpreted as illustrative and not in a limiting sense.

What is claimed is:

1. A drum brush percussion device comprising:
(a) a handle;
(b) a first plurality of wire bristles;
(c) a second plurality of wire bristles having proximal and distal ends and having protuberance means disposed between said proximal and distal ends at predetermined locations, the locations of said protuberance means being spaced from the distal ends of the majority of said wire bristles sufficient to allow the brush effect but not so far as to preclude striking the drumhead with the protuberance means.

2. A drum brush percussion device as recited in claim 1 in which said protuberance means are positioned at the end of wire bristles shorter in length than the majority of the bristles.

3. A drum brush percussion device as recited in claim 1 in which said protuberance means are located approximately one inch form said distal ends of said wire bristles.

4. A drum brush percussion device comprising:
(a) a handle;
(b) a first plurality of flexible bristles having proximal and distal ends and wherein pellets are disposed on said wire bristles in spaced relation to the distal ends of certain of said wire bristles, the locations of said pellets being spaced from the distal ends of the majority of said wire bristles sufficient to allow the brush effect but not so far as to preclude striking the drumhead with the pellets.

5. A drum brush percussion device as recited in claim 4 wherein:
each said pellet is affixed to a plurality of said wire bristles.

6. A drum brush percussion device as recited in claim 5 wherein:
said wire bristles fan out from said handle in substantially planar configuration.

7. A drum brush percussion device as recited in claim 6 further comprising:
a second plurality of flexible bristles having proximal and distal ends with pellets characterized thereat in spaced relation to said distal ends of said second plurality of said wire bristles such that the distance between said pellets and the distal ends of said second plurality of flexible bristles is not equal to the distance between the pellets and said distal end of said first plurality of wire bristles.

8. A drum brush percussion device as recited in claim 7 further comprising:
a third plurality of wire bristles having no pellets affixed thereto.

9. A drum brush percussion device as recited in claim 4 in which said pellets are positioned at the end of wire bristles shorter in length than the majority of the bristles.

10. A drum brush percussion device as recited in claim 4 in which said pellets are located approximately one inch from said distal ends of said wire bristles.

* * * * *